US012253272B1

(12) United States Patent
Jaber et al.

(10) Patent No.: US 12,253,272 B1
(45) Date of Patent: Mar. 18, 2025

(54) SYSTEMS AND METHODS FOR CONTROLLING INDOOR HUMIDITY

(71) Applicant: Trane International Inc., Davidson, NC (US)

(72) Inventors: Youssef A. Jaber, Tyler, TX (US); Don A. Schuster, Lindale, TX (US); Nathan Smith, Tyler, TX (US); Jonathan Edward Thrift, Jacksonville, TX (US)

(73) Assignee: Trane International Inc., Davidson, NC (US)

( * ) Notice: Subject to any disclaimer, the term of this patent is extended or adjusted under 35 U.S.C. 154(b) by 306 days.

(21) Appl. No.: 16/509,240

(22) Filed: Jul. 11, 2019

(51) Int. Cl.

| | |
|---|---|
| ***F24F 11/30*** | (2018.01) |
| ***F24F 3/14*** | (2006.01) |
| *F24F 11/86* | (2018.01) |
| *F24F 110/20* | (2018.01) |
| *F25B 49/02* | (2006.01) |

(52) U.S. Cl.
CPC ..... *F24F 11/30* (2018.01); *F24F 3/14* (2013.01); *F24F 11/86* (2018.01); *F24F 2110/20* (2018.01); *F25B 49/02* (2013.01); *F25B 49/022* (2013.01); *F25B 2700/02* (2013.01)

(58) Field of Classification Search
CPC ..... F24F 11/30; F24F 3/14; F24F 2110/20; F24F 11/86; F25B 49/02; F25B 49/022; F25B 2700/02
See application file for complete search history.

(56) References Cited

U.S. PATENT DOCUMENTS

| | | | | |
|---|---|---|---|---|
| 4,291,542 | A | 9/1981 | Sminge et al. | |
| 4,523,435 | A | 6/1985 | Lord | |
| 4,932,217 | A * | 6/1990 | Meyer | F25D 21/002 62/155 |

(Continued)

FOREIGN PATENT DOCUMENTS

| | | | |
|---|---|---|---|
| CN | 103423835 | A | 12/2013 |
| CN | 104006485 | A | 8/2014 |

(Continued)

OTHER PUBLICATIONS

Iwamoto, Air Conditioner for Vehicle, Oct. 21, 2010, JP2010234836A, Whole Document (Year: 2010).*

(Continued)

*Primary Examiner* — Larry L Furdge
(74) *Attorney, Agent, or Firm* — Womble Bond Dickinson (US) LLP

(57) ABSTRACT

Methods and related systems for controlling indoor relative humidity include (a) determining a target dew point temperature based on desired indoor conditions for the indoor space, and (b) determining an initial dew point temperature based on an initial set of current indoor conditions of the indoor space. The method includes (c) determining a target coil temperature of a coil of an indoor heat exchanger of the climate control system based on the target dew point temperature and the initial dew point temperature, and (d) adjusting a speed of air flowing across the coil or a speed of a compressor of the climate control system after (c) based on the target coil temperature to reduce a difference between a coil temperature of the coil and the target coil temperature.

19 Claims, 3 Drawing Sheets

(56) References Cited

U.S. PATENT DOCUMENTS

| | | | | |
|---|---|---|---|---|
| 5,062,276 | A * | 11/1991 | Dudley | F24F 11/00 62/176.6 |
| 5,144,812 | A | 9/1992 | Mills et al. | |
| 5,475,986 | A | 12/1995 | Bahel et al. | |
| 5,771,703 | A | 6/1998 | Rajendran | |
| 5,992,161 | A * | 11/1999 | O'Halloran | F24F 3/167 62/90 |
| 6,109,533 | A | 8/2000 | Ao et al. | |
| 6,269,650 | B1 | 8/2001 | Shaw | |
| 7,975,495 | B2 | 7/2011 | Voorhis et al. | |
| 8,156,750 | B2 | 4/2012 | Butorac et al. | |
| 9,696,067 | B2 | 7/2017 | Rite et al. | |
| 10,247,459 | B2 | 4/2019 | Nishiyama et al. | |
| 2002/0124585 | A1* | 9/2002 | Bash | H01L 23/473 62/228.4 |
| 2004/0107715 | A1 | 6/2004 | Lee et al. | |
| 2004/0244393 | A1 | 12/2004 | Lucas et al. | |
| 2008/0135635 | A1 | 6/2008 | Deng et al. | |
| 2008/0184715 | A1* | 8/2008 | Chen | F25B 47/022 62/81 |
| 2009/0151378 | A1 | 6/2009 | Kawakatsu et al. | |
| 2009/0192650 | A1 | 7/2009 | Tonner | |
| 2009/0299529 | A1* | 12/2009 | Hill | B60H 1/00785 700/275 |
| 2010/0180630 | A1 | 7/2010 | Ogawa | |
| 2010/0223941 | A1* | 9/2010 | Shah | F24F 11/62 62/507 |
| 2010/0300125 | A1* | 12/2010 | Cikanek | F25B 49/022 62/115 |
| 2011/0041539 | A1* | 2/2011 | Nylykke | F25D 17/042 62/276 |
| 2012/0067070 | A1* | 3/2012 | Albertson | F25B 13/00 62/126 |
| 2012/0090337 | A1* | 4/2012 | Chen | F25B 49/025 29/890.035 |
| 2012/0152515 | A1* | 6/2012 | Okabe | B60H 1/00785 165/287 |
| 2013/0174591 | A1 | 7/2013 | Das et al. | |
| 2013/0340452 | A1* | 12/2013 | Kleman | F25B 41/34 62/126 |
| 2014/0165612 | A1 | 6/2014 | Qu et al. | |
| 2014/0182832 | A1* | 7/2014 | Styles | B60H 1/00278 165/42 |
| 2014/0345307 | A1 | 11/2014 | Bagley et al. | |
| 2015/0059373 | A1 | 3/2015 | Maiello et al. | |
| 2015/0068226 | A1 | 3/2015 | Rite et al. | |
| 2016/0159198 | A1 | 6/2016 | Tang et al. | |
| 2016/0200176 | A1 | 7/2016 | Stanke et al. | |
| 2016/0236538 | A1 | 8/2016 | Suzuki et al. | |
| 2016/0290671 | A1 | 10/2016 | Schuster et al. | |
| 2017/0108231 | A1* | 4/2017 | Hasegawa | F24F 3/147 |
| 2017/0153037 | A1 | 6/2017 | Goel et al. | |
| 2017/0211833 | A1 | 7/2017 | Tran et al. | |
| 2017/0343260 | A1 | 11/2017 | Austin et al. | |
| 2017/0370608 | A1 | 12/2017 | Okochi | |
| 2018/0058740 | A1 | 3/2018 | Nishiyama et al. | |
| 2018/0373278 | A1 | 12/2018 | Walser | |
| 2021/0084835 | A1* | 3/2021 | Bowling | A01G 9/24 |

FOREIGN PATENT DOCUMENTS

| | | | |
|---|---|---|---|
| CN | 104990236 | A | 10/2015 |
| CN | 105650812 | A | 6/2016 |
| CN | 109855185 | A * | 6/2019 |
| EP | 2488796 | B1 | 12/2018 |
| JP | H0350437 | A | 3/1991 |
| JP | 2001272084 | A * | 10/2001 |
| JP | 2001317795 | A | 11/2001 |
| JP | 2007-010254 | A | 1/2007 |
| JP | 2010234836 | A * | 10/2010 |
| WO | 2009088517 | A1 | 7/2009 |

OTHER PUBLICATIONS

Tanaka et al., Air Conditioner, Oct. 5, 2001, JP2001272084A, Whole Document (Year: 2001).*

Yang et al., Air Conditioner and Dehumidification Control Method Thereof, Jun. 17, 2019, CN109855185A, Whole Document (Year: 2019).*

Qi, Qi, et al.; "Multivariable Control of Indoor Air Temperature and Humidity in a Direct Expansion (DX) Air Conditioning (A/C) System"; Building and Environment 44; 2009; 9 pages.

Lin, Xiaojie, et al.; "Review of Temperature and Humidity Control Technology for Heat Pump and Air Conditioning Systems"; 16th International Refrigeration and Air Conditioning Conference at Purdue; Jul. 11-14, 2016; 10 pages.

Ootori, Air Conditioner, Mar. 5, 1991, JPH0350437A, Whole Document (Year: 1991).

Shibata, Air Conditioner, Jan. 18, 2007, JP2007010254A, Whole Document (Year: 2007).

Wu, Method for Controlling Indoor Fan Rotating Speed of Air Conditioner under Heating Mode, Aug. 27, 2014, CN104006485A, Whole Document (Year: 2014).

* cited by examiner

SYSTEMS AND METHODS FOR CONTROLLING INDOOR HUMIDITY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The climate of an indoor space (e.g., such as a residential home, office space, storage unit, etc.) may be controlled by a climate control system, such as a heating, ventilation, and air conditioning (HVAC) system, a de-humidification system, etc. While temperature may be a focus for the control and operation of such climate control systems, indoor relative humidity may also be a relevant factor. Specifically, if an indoor relative humidity is not properly controlled, property damage and/or occupant discomfort may occur.

BRIEF SUMMARY

Some embodiments disclosed herein are directed to a method of operating a climate control system for an indoor space. In an embodiment, the method includes (a) determining a target dew point temperature based on desired indoor conditions for the indoor space, and (b) determining an initial dew point temperature based on an initial set of indoor conditions of the indoor space. In addition, the method includes (c) determining a target coil temperature of a coil of an indoor heat exchanger of the climate control system based on the target dew point temperature and the initial dew point temperature, and (d) adjusting a speed of air flowing across the coil or a speed of a compressor of the climate control system after (c) based on the target coil temperature to reduce a difference between a coil temperature of the coil and the target coil temperature.

Other embodiments disclosed herein are directed to a climate control system for an indoor space. In an embodiment, the climate control system includes an indoor heat exchanger, comprising a coil to flow refrigerant therethrough, a sensor configured to detect a value indicative of a coil temperature of the coil, and an indoor fan configured to flow air over the coil. In addition, the system includes a controller to be coupled to the sensor, the indoor fan, and the compressor. The controller is configured to determine a target dew point temperature based on desired indoor conditions for the indoor space. In addition, the controller is configured to determine a target coil temperature of the coil based on the target dew point temperature and current indoor conditions and a current dew point temperature that is based on the current indoor conditions. Further, the controller is configured to adjust a speed of the indoor fan or a speed of the compressor to reduce a difference between a current coil temperature of the coil and the target coil temperature.

Still other embodiments disclosed herein are directed to non-transitory machine readable medium including instructions that are to be executed by a processor. In an embodiment, the machine readable medium includes instructions that, when executed by the processor, cause the processor to: determine a target dew point temperature based on desired indoor conditions for an indoor space; determine a target coil temperature of an indoor heat exchanger of a climate control system for the indoor space based on the target dew point temperature and an initial dew point temperature that is based on an initial set of indoor conditions; and adjust a speed of air flowing across the coil or a speed of a compressor of the climate control system based on the target coil temperature.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
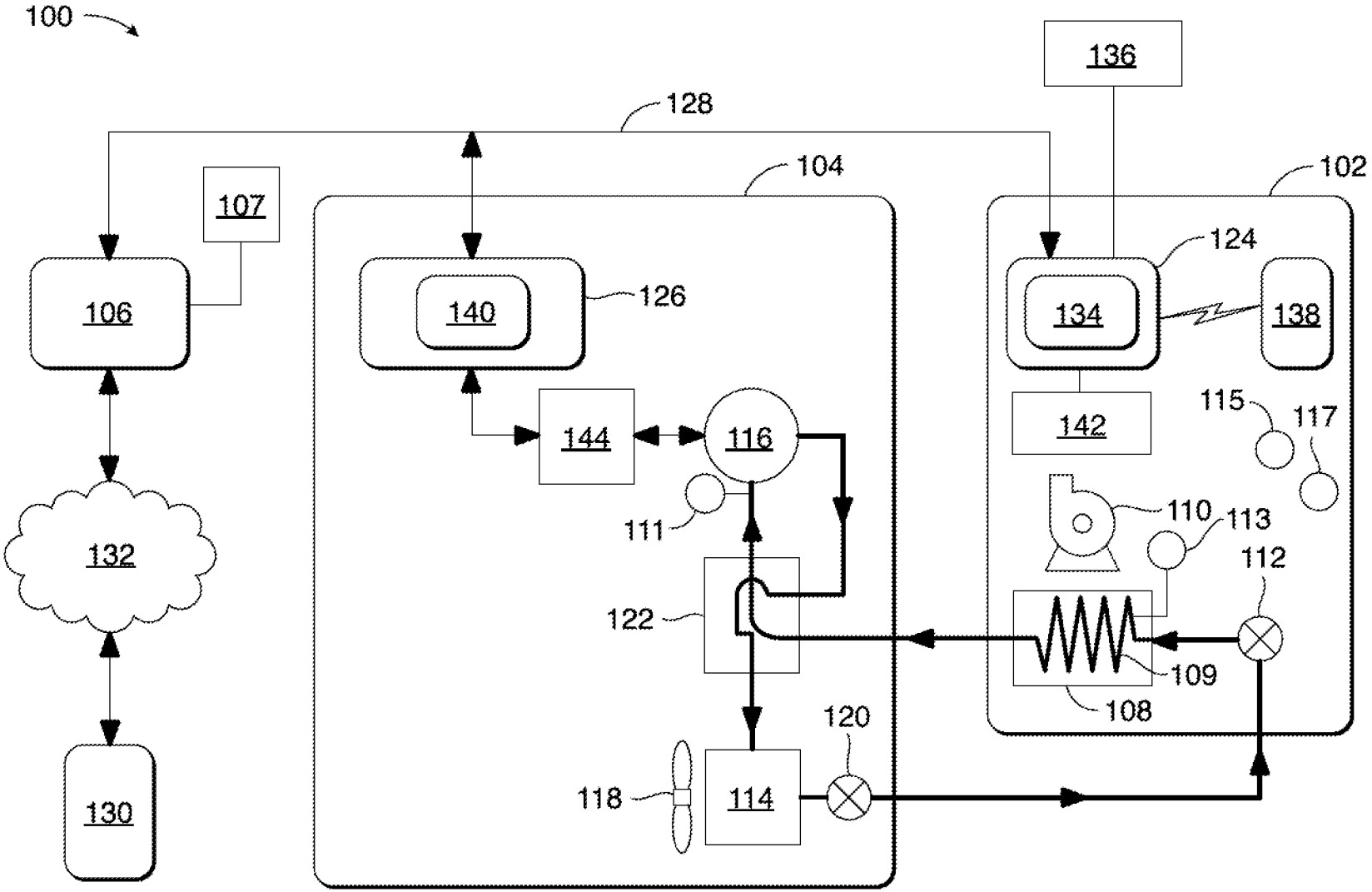
FIG. 1 is a diagram of a HVAC system configured for operating in a cooling mode according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

As previously described, indoor relative humidity may be a driving factor in the operation and control of a climate control system. Some climate control systems may include a humidity sensor that provides feedback related to a measured indoor humidity such that the climate control system may utilize the feedback from the humidity sensor in an effort to affect or otherwise control the indoor humidity during operations. However, as the demands for further energy efficiency of climate control systems increase, a climate control system designer may wish to further enhance the control of a climate control system to affect indoor relative humidity while ensuring a relatively high level of system efficiency. Accordingly, embodiments disclosed herein include systems and methods for controlling a relative humidity of an indoor space based on a temperature of an evaporator coil as well as current and desired indoor conditions. As will be described in more detail below, use of the embodiments disclosed herein, may allow a climate control system to effectively and efficiently control the relative humidity of an indoor space.

Referring now to FIG. 1, a schematic diagram of a climate control system 100 according to some embodiments is shown. In this embodiment, climate control system 100 is an HVAC system, and thus, system 100 may be referred to herein as HVAC system 100. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. Specifically, indoor heat exchanger 108 may include a coil 109 for channeling the refrigerant therethrough that segregates the refrigerant from any air flowing through indoor heat exchanger 108 during operations. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a centrifugal blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 (specifically across or over the coil 109) to promote heat transfer between the airflow and a refrigerant flowing through the coil 109 of the indoor heat exchanger 108. The indoor fan 110 may also be configured to deliver temperature-conditioned air from the indoor unit 102 to one or more areas and/or zones of an indoor space. The indoor fan 110 may generally comprise a mixed-flow fan and/or any other suitable type of fan. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger. While not specifically shown, it should be appreciated that outdoor heat exchanger 114 may include a coil similar to coil 109 previously described above for indoor heat exchanger 108.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In some embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the indoor heat exchanger 108. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flow path of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate, directly or indirectly, with a plurality of sensors associated with components of the indoor unit 102, the outdoor unit 104, etc. The sensors may measure or detect a variety of parameters, such as, for example, pressure, temperature, and flow rate of the refrigerant as well as pressure and temperature of other components or fluids of or associated with HVAC system 100. In some embodiments, the HVAC system 100 may include a sensor (or plurality of sensors) for sensing or detecting the ambient outdoor temperature. Additionally, in some embodiments, the system controller 106 may comprise a temperature sensor and/or may further be configured to control heating and/or cooling of zones associated with the HVAC system 100 (e.g., within the indoor space). In some embodiments, the system controller 106 may be configured as a thermostat, having a temperature sensor and a user interface, for controlling the supply of conditioned air to zones associated within the HVAC system 100.

In some embodiments, HVAC system 100 may include a pressure sensor 111 configured to sense or detect a pressure of the refrigerant at the suction side of compressor 116. In addition, HVAC system 100 may include a temperature sensor 113 configured to sense or detect a temperature of the coil 109 of the indoor heat exchanger 108. In some embodiments, the temperature of the coil 109 in indoor heat exchanger 108 (e.g., the temperature measured by sensor 113) may comprise the external temperature of the coil 109, the temperature of the refrigerant flowing through the coil 109, or a combination thereof. In some embodiments, the material forming the coil 109 may be thermally conductive, so that a temperature of the refrigerant flowing within the coil 109 may be the same, substantially the same, or relatively close to the temperature of the coil 109 itself. Each of the sensors 111, 113 may be coupled to system controller 106 (e.g., either directly or through one of the indoor controller 124 and outdoor controller 126) through a suitable communication path (which may be any suitable wired communication path, wireless communication path, or a combination thereof). In some embodiments, one or both of the sensors 111, 113 is omitted from the HVAC system 100.

In addition, in some embodiments, HVAC system 100 may include a humidity sensor 115 and a temperature sensor 117 for sensing or detecting a humidity (e.g., a relative humidity) and temperature (e.g., dry bulb temperature), respectively, of the indoor space that is being climate controlled by the HVAC system 100. In some embodiments, the humidity sensor 115 and temperature sensor 117 may be incorporated with a user interface located within the indoor space, but other locations and arrangements for humidity sensor 115 and temperature sensor 117 are possible. As was previously described above for the sensors 111, 113, humidity sensor 115 and temperature sensor 117, such as within the air flow path through the indoor unit 102, may be coupled to system controller 106 (e.g., either directly or through one of the indoor controller 124 and outdoor controller 126) through a suitable communication path (which may be any suitable wired communication path, wireless communication path, or a combination thereof).

The system controller 106 may also be in communication with an input/output (I/O) unit 107 (e.g., a graphical user interface, a touchscreen interface, or the like) for displaying information and for receiving user inputs. The I/O unit 107 may display information related to the operation of the HVAC system 100 (e.g., from system controller 106) and may receive user inputs related to operation of the HVAC system 100. During operations, I/O unit 107 may communicate received user inputs to the system controller 106, which may then execute control of HVAC system 100 accordingly. Communication between the I/O unit 107 and system controller 106 may be wired, wireless, or a combination thereof. In some embodiments, the I/O unit 107 may further be operable to display information and receive user inputs tangentially and/or unrelated to operation of the HVAC system 100. In some embodiments, however, the I/O unit 107 may not comprise a display and may derive all information from inputs from remote sensors and remote configuration tools (e.g., remote computers, servers, smartphones, tablets, etc.). In some embodiments, system controller 106 may receive user inputs from remote configuration tools, and may further communicate information relating to HVAC system 100 to I/O unit 107. In these embodiments, system controller 106 may or may not also receive user inputs via I/O unit 107.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

System controller 106, indoor controller 124, and outdoor controller 126 (as well as compressor drive controller 144, indoor fan controller 142, indoor EEV controller 138, etc.) may each comprise any suitable device or assembly which is capable of receiving electrical (or other data) signals and transmitting electrical (or other data) signals to other devices. In particular, while not specifically shown, system controller 106, indoor controller 124, and outdoor controller 126 (as well as controllers 138, 142, 144, etc.) may each include a processor and a memory. The processors (e.g., microprocessor, central processing unit, or collection of such processor devices, etc.) may execute machine readable instructions (e.g., non-transitory machine readable medium) provided on the corresponding memory to provide the processor with all of the functionality described herein. The memory of each controller 106, 124, 126 may comprise volatile storage (e.g., random access memory), non-volatile storage (e.g., flash storage, read only memory, etc.), or combinations of both volatile and non-volatile storage. Data consumed or produced by the machine readable instructions can also be stored on the memory of controllers 106, 124, 126.

During operations, system controller 106 may generally control the operation of HVAC system 100 through the indoor controller 124 and outdoor controller 126 (e.g., via communication bus 128). In the description below, specific control methods are described (e.g., method 200). It should be understood that the features of these described methods may be performed (e.g., wholly or partially) by system controller 106, or by one or more of the indoor controller 124, and outdoor controller 126 as directed by system controller 106. As a result, the controller or controllers of HVAC system 100 (e.g., controllers 106, 124, 126, 142, 144, 138, etc.) may include and execute machine-readable instructions (e.g., non-volatile machine readable instructions) for performing the operations and methods described in more detail below. In some embodiments, each of the controllers 106, 124, 126 may be embodied in a singular control unit, or may be dispersed throughout the individual controllers 106, 124, 126 as described above.

As shown in FIG. 1, the HVAC system 100 is configured for operating in a so-called cooling mode in which heat may generally be absorbed by refrigerant at the indoor heat exchanger 108 and rejected from the refrigerant at the outdoor heat exchanger 114. Starting at the compressor 116, the compressor 116 may be operated to compress refrigerant and pump the relatively high temperature and high pressure compressed refrigerant through the reversing valve 122 and to the outdoor heat exchanger 114, where the refrigerant may transfer heat to an airflow that is passed through and/or into contact with the outdoor heat exchanger 114 by the outdoor fan 118. After exiting the outdoor heat exchanger 114, the refrigerant may flow through and/or bypass the outdoor metering device 120, such that refrigerant flow is not substantially restricted by the outdoor metering device 120. Refrigerant generally exits the outdoor metering device 120 and flows to the indoor metering device 112, which may meter the flow of refrigerant through the indoor metering device 112, such that the refrigerant downstream of the indoor metering device 112 is at a lower pressure than the refrigerant upstream of the indoor metering device 112. From the indoor metering device 112, the refrigerant may enter the indoor heat exchanger 108. As the refrigerant is passed through coil 109 of the indoor heat exchanger 108, heat may be transferred to the refrigerant from an airflow that is passed through and/or into contact with the indoor heat exchanger 108 by the indoor fan 110. Refrigerant leaving the indoor heat exchanger 108 may flow to the reversing valve 122, where the reversing valve 122 may be selectively configured to divert the refrigerant back to the compressor 116, where the refrigeration cycle may begin again.

Figure 2:
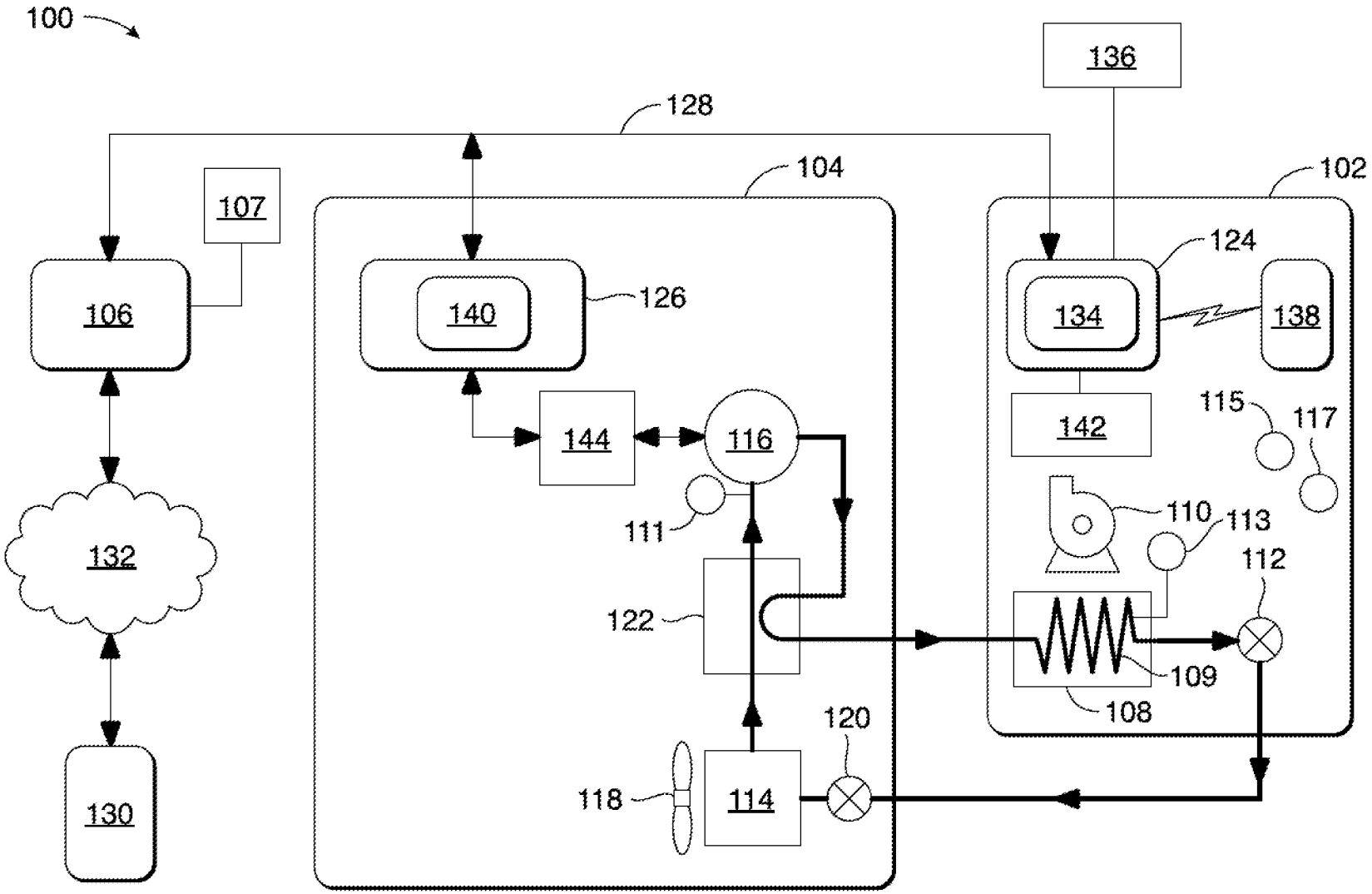
FIG. 2 is a diagram of the HVAC system of FIG. 1 configured for operating in a heating mode according to some embodiments.

Reference is now made to FIG. 2, which shows the HVAC system 100 configured for operating in a so-called heating mode. Most generally, the roles of the indoor heat exchanger 108 and the outdoor heat exchanger 114 are reversed as compared to their operation in the above-described cooling mode. For example, the reversing valve 122 may be controlled to alter the flow path of the refrigerant from the compressor 116 to the indoor heat exchanger 108 first and then to the outdoor heat exchanger 114, the outdoor metering device 120 may be enabled, and the indoor metering device 112 may be disabled and/or bypassed. In heating mode, heat may generally be absorbed by refrigerant at the outdoor heat exchanger 114 and rejected by the refrigerant at the indoor heat exchanger 108. As the refrigerant is passed through the outdoor heat exchanger 114, the outdoor fan 118 may be operated to move air into contact with the outdoor heat exchanger 114, thereby transferring heat to the refrigerant from the air surrounding the outdoor heat exchanger 114. Additionally, as refrigerant is passed through coil 109 of the indoor heat exchanger 108, the indoor fan 110 may be operated to move air into contact with the indoor heat exchanger 108, thereby transferring heat from the refrigerant to the air surrounding the indoor heat exchanger 108.

Figure 3:
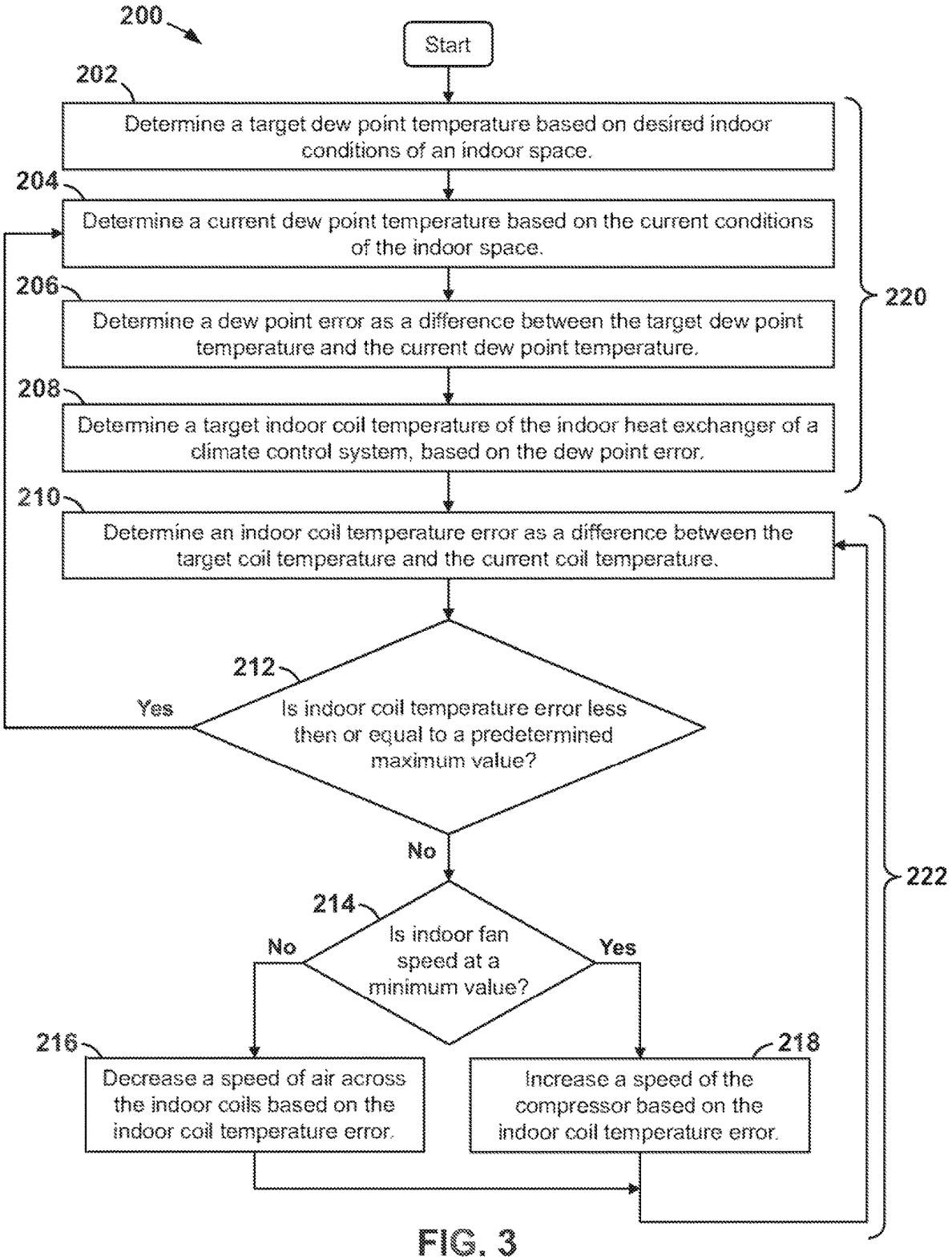
FIG. 3 is a flow chart of a method of controlling humidity within an indoor space according to some embodiments.

Referring now to FIG. 3, a method 200 of controlling humidity within an indoor space (e.g., such as a residential dwelling, office space, etc.) is shown. In some embodiments, method 200 may be practiced with HVAC system 100, while HVAC system 100 is being operated in the cooling mode as previously described above (see e.g., FIG. 1). Thus, in describing the features of method 200, continuing reference will made to the HVAC system 100 shown in FIG. 1; however, it should be appreciated that embodiments of method 200 may be practiced with other systems, assemblies, and devices.

Generally speaking, method 200 includes a first or target coil temperature determination loop 220 (including blocks 202, 204, 206, 208) and a second or coil temperature adjustment loop 222 (including blocks 210, 212, 214, 216, 218). As will be described in more detail below, target coil temperature determination loop 220 may provide a target coil temperature for a climate control system of an indoor space. For instance, within the HVAC system 100 of FIG. 1, first loop 220 may determine a target or desired temperature of the coil 109 of indoor heat exchanger 108 that may effectively reduce a humidity of the indoor space. Next, coil temperature adjustment loop 222 may adjust the coil temperature to achieve the target coil temperature provided by loop 220. As will be described in more detail below, performance of some or all of the steps of loops 220, 222 may be cyclical or repeated during the operation of the climate control system (e.g., HVAC system 100) so as to continuously control the humidity within the indoor space. Each of the features of method 200, including the features of loops 220, 222 are now discussed in more detail below.

Initially, method 200 includes determining a target dew point temperature based on desired indoor conditions of an indoor space at 202. The desired indoor conditions may comprise a desired indoor temperature and a desired indoor humidity. The desired indoor conditions may be user-selected (e.g., via selection by a user on a thermostat or other suitable user input device). In some embodiments, the desired indoor conditions (or some of the desired indoor conditions) may be derived, determined, or calculated based on other values or parameters (which may be user-selected values or parameters). For instance, a desired indoor relative humidity may be derived or determined based on a desired indoor temperature, an outdoor relative humidity, etc. In addition, in some embodiments, the desired indoor temperature may comprise a so-called dry-bulb temperature (or a temperature as measured or determined by an appropriate device that is shielded from radiation and moisture).

Once the desired indoor conditions are obtained as described above a target dew point temperature may be calculated from the desired indoor conditions. For instance, without being limited to this or any other theory, the target dew point temperature may be calculated (or estimated) by the following computation, where the desired indoor temperature is represented by $T_{des}$, and the desired indoor relative humidity is represented by $RH_{des}$:

$$\text{Target Dew Point Temperature} \approx T_{des} - \frac{100 - RH_{des}}{5}. \tag{1}$$

Other calculation methods may be used to calculate the target dew point temperature other than Equation (1) above in some embodiments. For instance, in some embodiments, the target dew point temperature may be calculated (or estimated) by the following computation, which is known as the Magnus formula:

$$\text{Target Dew Point Temperature} = \frac{c\gamma(T_{des}, RH_{des})}{b - \gamma(T_{des}, RH_{des})}; \tag{2}$$

$$\text{whe}\gamma(T_{des}, RH_{des}) = \ln\left(\frac{RH_{des}}{100}\right) + \frac{bT_{des}}{c + T_{des}}. \tag{3}$$

In Equations (2) and (3) above, the constants "c" and "b" may have a number of different values (depending on the specific convention and methods followed). However, in some embodiments, the constants "b" and "c" may equal approximately 17.625 and 243.04° C., respectively. As an example, if desired indoor conditions included a temperature of 79.5° F. and a relative humidity of 48%, the target dew point calculation per equations (2) and (3) above would be equal to approximately 58.1° F.

In still other embodiments, the target dew point may be determined at 202 by consulting a lookup table that relates values of desired indoor temperature and desired indoor relative humidity to dew point temperatures. In these embodiments, if a value of the desired indoor temperature and/or the desired indoor relative humidity fall between stated values within the lookup table, the value of the target dew point may be interpolated.

Referring still to FIG. 3, method 200 also includes determining a current dew point temperature based on the current conditions of the indoor space at 204 (the "current conditions of the indoor space" may be more simply referred to herein as "current indoor conditions"). In some embodiments, the current indoor conditions may include a current indoor temperature (e.g., a current dry-bulb temperature) and a current indoor relative humidity. Referring briefly again to FIG. 1, within HVAC system 100, determining the current indoor conditions may comprise determining a current indoor temperature with the temperature sensor 117 and determining a current indoor relative humidity with the humidity sensor 115.

Once the current indoor conditions are determined (e.g., measured, inferred, calculated, estimated, or combinations thereof), the current dew point temperature may be calculated based on the current indoor conditions. For instance, the current dew point temperature may be calculated per one or more of the calculation methods previously described above for the target dew point temperature (except that the calculation is based on the current indoor conditions rather than the desired indoor conditions).

Referring again to FIG. 3, method 200 includes determining a dew point error as a difference between the desired dew point temperature and the current dew point temperature at 206. For instance, in some embodiments, the dew point error may be determined in 206 by subtracting the desired dew point temperature from the current dew point temperature. In some embodiments, method 200 may additionally determine if the desired relative humidity is greater than or equal to the current relative humidity such that further dehumidification operations may not be necessary. In some of these embodiments, method 200 may make this determination by considering a difference between the desired dew point temperature and the current dew point temperature as a proxy for the desired relative humidity and the current relative humidity. In some embodiments, a relative humidity error may be calculated or determined at 206 as a difference between a target relative humidity and the current relative humidity within the indoor space.

Once a dew point error is determined at 206, method 200 next includes determining a target indoor coil temperature of an indoor heat exchanger of a climate control system (e.g., HVAC system 100) based on the dew point error at 208 (or perhaps based on a relative humidity error previously described above for some embodiments). Referring briefly again to FIG. 1, in some embodiments, the target indoor coil temperature may comprise a temperature of coil 109 (or a temperature of the refrigerant flowing through coil 109) of indoor heat exchanger 108 as previously described. In addition, in some embodiments the target indoor coil temperature may be reduced or offset below the target dew point temperature by a determined amount. The magnitude of this temperature offset may be based on the magnitude of the dew point error previously determined at 206. For instance, in some embodiments the offset of the indoor coil temperature may be proportional to the magnitude of the dew point error determined at 206.

In some embodiments, a proportional and integral (PI) control loop, function, or scheme may be applied at 208 to provide the target indoor coil temperature utilizing the dew point error as a feedback. Specifically, in some embodiments, an initial target coil temperature may be set to the desired dew point temperature. Next, a PI control loop may be initiated, utilizing the dew point error as a feedback loop. During this process, proportional and integral gain values may be utilized in addition to the dew point error to compute the desired indoor coil temperature at blocks 208. These gain values may be derived experimentally or empirically and may be specific to a type, size, model, etc. of various components within the climate control system (e.g., HVAC system 100). In some embodiments, a target range (e.g., a target indoor coil temperature range) may be computed at block 208, as a part of the PI control loops described above.

In general, the amount of moisture condensed out of the air flowing through indoor heat exchanger 108 is increased as the temperature of coil 109 is reduced farther below the dew point temperature of the air flowing across coil 109. Thus, in some embodiments as the difference between the desired relative humidity and the current indoor relative humidity increases (e.g., the current indoor relative humidity is much higher than the desired relative humidity), the target indoor coil temperature also decreases relative to the target dew point at 208 in order to more quickly condense moisture out of the indoor air and therefore more effectively reduce the indoor relative humidity toward the desired value.

Referring again to FIG. 3, once a target coil temperature is determined within the target coil temperature determination loop 220 as described above, method 200 then proceeds to adjust a current coil temperature in the evaporator coil of the climate control system toward the target coil temperature within the coil temperature adjustment loop 222 as previously described.

More specifically, within the coil temperature adjustment loop 222, method 200 includes determining an indoor coil temperature error as a difference between the target coil temperature and a current coil temperature at 210. The coil temperature may be directly or indirectly measured, detected, estimated, or inferred. Specifically, referring briefly again to FIG. 1, in some embodiments, the current temperature of the coil 109 may be measured at 210 with the temperature sensor 113 as previously described.

Alternatively, in some embodiments the current temperature of coil 109 may be indirectly measured or estimated from other measured values or parameters at 210. For instance, in some embodiments, a pressure of the refrigerant may be measured or detected at any suitable location within HVAC system 100 (e.g., within outdoor unit 104, indoor unit 102, etc.), and then the temperature of coil 109 may then be calculated or estimated based on known relationships and variables. Specifically, in some embodiments, pressure sensor 111 may measure a pressure of the refrigerant at the suction side of compressor 116. This measured pressure may be converted (e.g., via a look up table or suitable calculation, etc.) into a saturated suction temperature (SST) of the refrigerant at the measured pressure. As used herein, "saturation suction temperature" refers to the temperature at which the refrigerant boils/vaporizes within the evaporator coils for a given pressure. Thus, a derived value for SST may not reflect the actual temperature of the refrigerant at the suction of the compressor 116, but instead reflects the approximate phase change temperature of the refrigerant (e.g., vaporization temperature) at the measured pressure (e.g., as measured by sensor 111). During operation of HVAC system 100 in the above described "cooling mode," the refrigerant is to change phase from liquid to a vapor as it absorbs heat energy from the air flowing across the coil 109. Thus, while the refrigerant is in the coil 109, it remains at (or substantially at) the vaporization temperature until all (or again substantially all) of the liquid refrigerant has vaporized. Thereafter, the refrigerant begins to increase in temperature above the vaporization temperature as additional heat energy is absorbed from the air flowing across the coil 109. This additional temperature increase is typically referred to as "superheat." Thus, the SST value of the refrigerant (which may be derived from the pressure of the refrigerant at the suction of compressor 116 via sensor 111 as previously described above), may provide the temperature of the refrigerant while it was flowing through the coil 109 (or during a majority of the time the refrigerant was flowing through the coil 109).

However, it should be noted that the pressure of the refrigerant at the suction side of the compressor 116 (e.g., the pressure measured by sensor 111) may be slightly lower than the pressure of the refrigerant within coil 109. This is driven by a number of factors (e.g., the length of the flow path between the coils, the relative diameters of flow paths within HVAC system 100, etc.). As a result, the derived value of SST may be less than the actual vaporization temperature of the refrigerant when it was flowing within the coil 109 (i.e., the coil temperature). Therefore, in some embodiments, an offset may be applied to the derived value of SST based on a known (or estimated) pressure difference of the refrigerant between coil 109 and compressor 116 to thereby give the coil temperature. In some embodiments, the offset between SST and the final coil temperature may be 5° F. or less, such as, for instance 3° F. or less, or 2° F. or less, etc.

Referring again to FIG. 3, once a value of the current coil temperature is determined or derived within the target coil temperature determination loop 220, method 200 proceeds to the coil temperature adjustment loop 222. Specifically, within the coil temperature adjustment loop 222, the indoor coil temperature error may be calculated at 210 by subtracting the target indoor coil temperature determined at 208 from the current indoor coil temperature. Thereafter, method 200 includes a determination at 212 as to whether the indoor coil temperature error is equal to or below a predetermined maximum value. For instance, a predetermined maximum value may be a set number of degrees (e.g., about 0.5° F., 1° F., 10° F., etc.) or a set percentage (e.g., 2%, 5%, 10%, etc.) above the target indoor coil temperature determined at 208. If it is determined that the indoor coil temperature error is equal to or below the predetermined maximum value at 212 (i.e., the determination at 212 is "Yes") the method 200 returns again to 204 to determine the indoor conditions within the target coil temperature determination loop 220. Thus, if the indoor relative humidity is within a predetermined range of the desired indoor relative humidity, method 200 may once again return to target coil temperature determination loop 220 (e.g., at 204) to reassess (e.g., adjust, update) the target coil temperature based on the changed/updated indoor conditions (e.g., indoor relative humidity).

If, on the other hand, it is determined that the indoor coil temperature error is above or greater than the predetermined maximum value at 212 (i.e., the determination at 212 is "No") then method 200 proceeds within the coil temperature adjustment loop 222 to determine whether the indoor fan speed is at a minimum value at block 214. Referring briefly to FIG. 1, indoor fan 110 may be operable at a number of different speeds to provide a variable flow rate of air across coil 109 as previously described above. Limits may be imposed on the operational range (e.g., the range of speeds) that indoor fan 110 may operate. For instance, in some embodiments, the blower motor that rotates the air moving components of indoor fan 110 (e.g., blades, impeller, etc.) may have a minimum speed for operation, or there may be regulatory or technical standards placing a lower limit on the speed of indoor fan 110. Thus, the minimum speed of the driver for blower 110 may translate to a minimum speed of blower 110 and therefore a minimum air speed across the coil 109. If it is determined that the indoor blower speed is not at a minimum value at 214 (i.e., the determination at 214 is "No"), then method 200 proceeds to decrease the indoor fan speed at 216. Without being limited to this or any other theory and referring briefly again to FIG. 1, lowering the indoor fan speed, and therefore the speed of air flowing across coil 109, may reduce an enthalpy transfer between the air flowing across the coil 109 and the refrigerant flowing within coil 109 so that a temperature of the refrigerant within the coil 109 may fall. Thus, by reducing the rate of air flowing across coil 109, the temperature of the coil 109 may be decreased to thereby reduce the indoor coil temperature error.

If, on the other hand, it is determined that that the indoor blower speed is at minimum value at 214, the method 200 proceeds to increase a speed of the refrigerant compressor at 218. Without being limited to this or any other theory, increasing a speed of the compressor also increases a mass flow rate of refrigerant through coil 109. Because of the increased refrigerant mass flow rate, the amount of enthalpy that is transferred from the air flowing within indoor heat exchanger 110 to each unit mass of refrigerant flowing within coil 109 is reduced, thereby resulting in a decrease in the temperature of coil 109. As a result, the increase in compressor speed (e.g., at 218 in method 200) may further work to reduce a temperature within coil 109 during operations. Thus, by increasing the speed of the compressor at 218, the temperature of the coil 109 may be decreased to thereby reduce an indoor coil temperature error.

At blocks 216, 218 of method 200, various logic, calculations, or control operations may be used to determine a magnitude of either the indoor fan speed reduction or compressor speed increase. For instance, in some embodiments, the changes to the speed of the indoor fan and/or compressor at 216, 218 may be based on (e.g., proportional to) the indoor coil temperature error from 210.

In addition, in some embodiments, method 200 may employ a PI control loop, function, or scheme at 216, 218 to provide the desired speed changes for the indoor fan and compressor. Specifically, in some embodiments the indoor coil temperature error from block 210 is used as a feedback error within a PI control loop for controlling the indoor fan speed at block 216, and within a PI control loop for controlling the compressor speed at block 218. During this process, proportional and integral gain values for both the indoor fan speed and the compressor speed may be utilized in addition the indoor coil temperature error to compute the desired speeds of the indoor fan and compressor at blocks 216, 218. These gain values may be derived experimentally or empirically and may be specific to a type, size, model, etc. of the indoor fan 110 and compressor 116. In some embodiments, a target range (e.g., a target speed range) may be computed for the indoor fan 110 and compressor 116 at blocks 216 and 218, respectively, as a part of the PI control loops described above, so as to adjust the indoor fan 110 and compressor 116 to a desired ranged of values (rather than a singular value) to affect the desired changes to the indoor coil temperature.

Following the reduction in the speed of the fan at 216 and/or increase in the speed of the compressor at 218, the method 200 then returns to determine the indoor coil temperature error at 210 based on a new current value of the coil temperature following the fan speed reductions at 216 and/or the compressor speed increases at 218. In addition, following the new determination of the indoor coil temperature error at 210, method 200 again determines whether the subsequently determined indoor coil temperature error is equal to or below the predetermined maximum value at 212 as previously described. Thus, subsequent speed changes for the indoor fan 110 and compressor at 216, 218 may be made in light of the changing temperature of the coil of the indoor heat exchanger.

Method 200 may be continuously repeated to achieve and maintain the desired indoor relative humidity. For instance, blocks 204-218 may be continuously and repeatedly performed so as to control the indoor relative humidity of an indoor space based on the desired indoor temperature and desired indoor relative humidity previously described. In addition, method 200 may be re-started at block 202 if a new set of desired indoor conditions are selected (e.g., user-selected via a thermostat or other suitable user input device). In some embodiments, with the cycling or repeating of steps within method 200 as described above (e.g., within and between target coil temperature determination loop 220, coil temperature adjustment loop 222, etc.), the target coil temperature may be continuously updated based on the changing indoor conditions (see e.g., the loop from block 212 to 204-210). Thus, without being limited to this or any other theory, the adjustments made to the indoor fan and/or the compressor at blocks 216, 218 may also be adjusted in light of the changing indoor coil target temperature. As a result, during operation of method 200 (e.g., such as with HVAC system 100), consumed energy may be reduced (or potentially minimized) so as to efficiently achieve and maintain the desired indoor relative humidity.

In addition, upon the initiation of a new or subsequent cooling cycle following the cessation of a previous cooling cycle within the climate control system (e.g., such as when the climate control system is triggered or activated due to a rise in the indoor temperature above a user-selected value or the selection of a lower temperature by a user at the I/O unit 107, etc.), method 200 may be re-started. In some embodiments, upon the re-starting of method 200 the values or modifications for the speed of air across the indoor coils and/or the speed of the compressor from the previous performance of method 200 (e.g., at blocks 216 and 218) may be maintained at the initial operation of the climate control system (e.g., HVAC system 100). In this way, the climate control system may be initially operated at a subsequent start up so as to drive the indoor coil temperature toward the last determined target coil temperature and therefore begin to condense excess moisture from the indoor space more quickly. Following the initial start-up of the climate control system (e.g., after steady-state conditions are reached), the blocks 202-218 of method 200 may be performed as previously described above so as to continue to adjust or fine tune the operational parameters (e.g., speeds) of the indoor fan and compressor.

As previously described, in some embodiments the vaporization temperature of the refrigerant (or a value that is related thereto) may be used as a proxy for the actual coil temperature during some or all blocks of method 200. Specifically, in some embodiments, the SST value may be obtained for the refrigerant (e.g., via pressure sensor 111 as previously described) and this SST value may be controlled in order to control an indoor coil temperature. Because SST provides a close approximation of the vaporization temperature of the refrigerant while flowing through coil 109, it may provide a suitable stand-in during the above described control operations of method 200. Thus, the above described operations (e.g., blocks) of method 200 may be altered in some embodiments to control operation of the climate control system (e.g., climate control system 100) based on a target SST in place of a target coil temperature. However, because SST is simply a stand-in (or proxy) for the actual coil temperature, operation of blocks 208-218 in this manner would still be considered to be adjustments of the indoor fan and the compressor based on a "target indoor coil temperature" as previously described.

In some embodiments, method 200 may determine whether the current relative humidity (and/or a current dew point) is below a lower limit or threshold, such as might be the case when the humidity within the indoor space is below a predetermined level associated with occupant comfort. In these embodiments, method 200 may also include blocks for adjusting the speed of air across the indoor coils and/or the speed of the compressor to raise the indoor coil temperature above dew point based on the current indoor conditions. For instance, in some of these embodiments, method 200 may include increasing a speed of air across the indoor coils and/or decreasing a speed of the compressor in order to decrease enthalpy transfer between the air flowing across the indoor coil and the refrigerant flowing within the indoor coil. As a result, additional condensation of moisture from the air within the internal space on the indoor coils may be prevented so as to avoid further reducing the indoor relative humidity.

Thus, through use of the systems and methods described herein (e.g., HVAC system 100, method 200, etc.), a humidity of an indoor space may be actively controlled based on desired indoor conditions. Specifically, an indoor relative humidity may be efficiently controlled by selectively reducing a coil temperature of an indoor heat exchanger (e.g., coil 109 of indoor heat exchanger 108) below a target dew point to achieve the desired indoor relative humidity based on the current and progressively changing indoor conditions. Thus, through use of the system and methods disclosed herein, humidity may be controlled within an indoor space without sacrificing the energy efficiency of the system as whole.

The above described systems and methods may include or incorporate the use of additional sensors within a climate control system to affect the humidity control methods described herein (e.g., sensors 111, 113, etc.), such that additional complexities and failure modalities are introduced, and one may not be motivated to implement such a system as a result. In addition, some might perceive the above described adjustments of system parameters (e.g., such as the compressor speed, indoor air speed, etc.) as a detriment to the system as a whole (e.g., since such adjustments may lead to instabilities within a climate control system during operations). However, the greatly enhanced humidity control achieved by the above described embodiments may provide substantial benefit for the operation of a climate control system as a whole to substantially outweigh these concerns.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method of operating a climate control system that includes HVAC equipment configured to provide conditioned air to an indoor space, the HVAC equipment including an indoor fan and a controller, the controller being coupled to the indoor fan and at least one sensor arranged to detect a temperature of at least one of either a component of the HVAC equipment or current indoor conditions of the indoor space, the method comprising:

(a) determining a target dew point temperature based on desired indoor conditions for the indoor space;

(b1) determining an initial dew point temperature based on an initial set of indoor conditions of the indoor space;

(b2) determining an updated dew point temperature based on an updated set of indoor conditions of the indoor space;

(b3) determining a dew point error based on a difference between the target dew point temperature and the updated dew point temperature;

(c1) setting, during a cooling mode, a target coil temperature of a coil of an indoor heat exchanger of the climate control system below the target dew point temperature by an amount based on a difference between the target dew point temperature and the initial dew point temperature;

(c2) adjusting, during the cooling mode, the target coil temperature to an adjusted target coil temperature, in part, using a proportional and integral control loop that utilizes the dewpoint error as a feedback; and (d) adjusting, during the cooling mode, a speed of air flowing across the coil and a speed of a compressor of the climate control system based on the adjusted target coil temperature, to reduce a difference between a coil temperature of the coil and the adjusted target coil temperature.

2. The method of claim 1, wherein adjusting the target coil temperature comprises increasing the target coil temperature.

3. The method of claim 1, wherein (d) comprises decreasing the speed of air flowing across the coil of the indoor heat exchanger to a predetermined minimum speed of the indoor fan of the climate control system.

4. The method of claim 3, wherein (d) comprises:

determining the coil temperature is above the target coil temperature after decreasing the speed of air flowing across the coil to the predetermined minimum speed; and further increasing the speed of the compressor based on the determination of the coil temperature.

5. The method of claim 1, wherein determining the coil temperature is based on a measurement of the refrigerant pressure.

6. The method of claim 1, comprising:

(e) stopping the climate control system;

(f) restarting the climate control system after (e); and (g) applying an adjusted speed of the air flowing across the coil or an adjusted speed of the compressor determined in (d) during the restarting the climate control system in (f).

7. The method of claim 1, wherein the steps of determining the updated dew point based on the updated set of indoor conditions at (b2), determining the dew point error based on the difference between the target dew point temperature and the updated dew point temperature at (b3), and adjusting the target coil temperature to the adjusted target coil temperature at (c2) are each repeated a plurality of times during the cooling mode to repeatedly adjust the target coil temperature, each of the plurality of times establishing an updated adjusted target coil temperature, wherein adjusting the speed of air flowing across the coil and the speed of the compressor based on the adjusted target coil temperature is based on the updated adjusted target coil temperature.

8. The method of claim 7, wherein the proportional and integral control loop is a first proportional and integral control loop, and wherein adjusting the speed of air flowing across the coil and the speed of the compressor at (d) includes, in part, using a second proportional and integral control loop to adjust the speed of air flowing across the coil and the speed of the compressor based on the updated adjusted coil temperature.

9. A climate control system for an indoor space, the climate control system comprising:

an indoor heat exchanger, comprising a coil to flow refrigerant therethrough;

a sensor configured to detect a value indicative of a coil temperature of the coil;

an indoor fan configured to flow air over the coil;

a compressor configured to compress refrigerant that is to be flowed through the coil; and a controller coupled to each of the sensor, the indoor fan, and the compressor, wherein the controller is configured to:

receive temperature information indicative of current indoor conditions of the indoor space;

determine a target dew point temperature based on desired indoor conditions for the indoor space;

receive an initial dew point temperature based on an initial set of indoor conditions of the indoor space;

receive an updated dew point temperature based on an updated set of indoor conditions of the indoor space;

determine a dew point error based on a difference between the target dew point temperature and the updated dew point temperature;

set, during a cooling mode, a target coil temperature of the coil below the target dew point temperature based on a difference between the target dew point temperature and the initial dew point temperature;

adjust, during the cooling mode, the target coil temperature to an adjusted target coil temperature, in part, using a proportional and integral control loop that utilizes the dewpoint error as a feedback; and adjust, during the cooling mode, a speed of the indoor fan and a speed of the compressor to reduce a difference between a current coil temperature of the coil and the adjusted target coil temperature.

10. The climate control system of claim 9, wherein, when the current coil temperature is above the adjusted target coil temperature, the controller is configured to:

decrease, incrementally, the speed of the indoor fan to a predetermined limit; and then determine that the current coil temperature remains above the adjusted target coil temperature; and then increase the speed of the compressor.

11. The climate control system of claim 9, wherein the controller is configured to decrease the adjusted target coil temperature based on the difference between the target dew point temperature and the updated dew point temperature increasing.

12. The climate control system of claim 9, wherein the controller configured to determine the updated dew point based on the updated set of indoor conditions, determine the dew point error based on the difference between the target dew point temperature and the updated dew point temperature, and adjust the target coil temperature to the adjusted target coil temperature is further configured to:

repeatedly perform the processes of determine the updated dew point based on the updated set of indoor conditions, determine the dew point error based on the difference between the target dew point temperature and the updated dew point temperature, and adjust the target coil temperature to the adjusted target coil temperature each a plurality of times during the cooling mode to repeatedly adjust the target coil temperature, each of the plurality of times establishing an updated adjusted target coil temperature, and wherein the controller configured to adjust the speed of the indoor fan and the speed of the compressor is further configured to adjust the speed of the indoor fan and the speed of the compressor to reduce the difference between the current coil temperature of the coil and the updated adjusted target coil temperature.

13. The climate control system of claim 12, wherein the proportional and integral control loop is a first proportional and integral control loop, and wherein the controller configured to adjust the speed of the indoor fan and the speed of the compressor is further configured to adjust the speed of the indoor fan and the speed of the compressor, in part, using a second proportional and integral control loop to adjust the speed of the indoor fan and the speed of the compressor to reduce the difference between the current coil temperature of the coil and the updated adjusted target coil temperature.

14. A controller including a non-transitory machine-readable medium for operating a climate control system that includes HVAC equipment configured to provide conditioned air to an indoor space, the HVAC equipment including an indoor fan and the controller, the controller being coupled to the indoor fan and to at least one sensor arranged to detect a temperature of at least one of either a component of the HVAC equipment or current indoor conditions of the indoor space, the non-transitory machine-readable medium including instructions that, when executed by the controller, cause the controller to:

determine a target dew point temperature based on desired indoor conditions for the indoor space;

determine an initial dew point temperature based on an initial set of indoor conditions of the indoor space;

determine an updated dew point temperature based on an updated set of indoor conditions of the indoor space;

determine a dew point error based on a difference between the target dew point temperature and the updated dew point temperature;

set, during a cooling mode, a target coil temperature of an indoor heat exchanger of the climate control system below the target dew point temperature based on a difference between the target dew point temperature and the initial dew point temperature;

adjust, during the cooling mode, the target coil temperature to an adjusted target coil temperature, in part, using a proportional and integral control loop that utilizes the dewpoint error as a feedback; and adjust, during the cooling mode, a speed of air flowing across the coil and a speed of a compressor of the climate control system based on the updated target coil temperature.

15. The controller of claim 14, wherein the instructions, when executed by the controller, further cause the controller to:

decrease, incrementally, the speed of air flowing across the coil when the current coil temperature is above the target coil temperature;

then determine a coil temperature of the coil remains above the adjusted target coil temperature; and then increase the speed of the compressor.

16. The controller of claim 15, wherein the instructions, when executed by the controller, further cause the controller to decrease the speed of air flowing across the coil to a predetermined minimum speed of the indoor fan of the climate control system before increasing the speed of the compressor.

17. The controller of claim 14, wherein the instructions, when executed by the controller, further cause the controller to:

determine a current coil temperature of the coil; and adjust the speed of the air flowing across the coil or the speed of the compressor based on a difference between the current coil temperature and the updated target coil temperature.

18. The controller of claim 14, wherein the instructions, when executed by the controller, that cause the controller to determine the updated dew point based on the updated set of indoor conditions, determine the dew point error based on the difference between the target dew point temperature and the updated dew point temperature, and adjust the target coil temperature to the adjusted target coil temperature further causes the controller to:

repeatedly perform the processes of determine the updated dew point based on the updated set of indoor conditions, determine the dew point error based on the difference between the target dew point temperature and the updated dew point temperature, and adjust the target coil temperature to the adjusted target coil temperature each a plurality of times during the cooling mode to repeatedly adjust the target coil temperature, each of the plurality of times establishing an updated adjusted target coil temperature, and wherein the instructions, when executed by the controller, that cause the controller to adjust the speed of air flowing across the coil and the speed of the compressor further cause the controller to adjust the speed of air flowing across the coil and the speed of the compressor to reduce the difference between the current coil temperature of the coil and the updated adjusted target coil temperature.

19. The controller of claim 18, wherein the proportional and integral control loop is a first proportional and integral control loop, and wherein the instructions, when executed by the controller, that cause the controller to adjust the speed of air flowing across the coil and the speed of the compressor further cause the controller to adjust the speed of air flowing across the coil and the speed of the compressor, in part, using a second proportional and integral control loop to adjust the speed of air flowing across the coil and the speed of the compressor to reduce the difference between the current coil temperature of the coil and the updated adjusted target coil temperature.

* * * * *